US005230169A

United States Patent [19]

Jaatinen et al.

[11] Patent Number: 5,230,169

[45] Date of Patent: Jul. 27, 1993

[54] STEAM AND CONDENSATE COUPLING FOR A DRYING CYLINDER IN A PAPER MACHINE

[75] Inventors: Erkki Jaatinen; Kalervo Jussila, both of Jyväskylä ; Esa Moilanen, Oulu; Olavi Viitanen, Jyväskylä, all of Finland

[73] Assignee: Valmet Paper Machinery Inc., Finland

[21] Appl. No.: 832,355

[22] Filed: Feb. 7, 1992

[30] Foreign Application Priority Data

Feb. 14, 1991 [FI] Finland ..... 910721

[51] Int. Cl.[5] ..... F26B 13/08

[52] U.S. Cl. ..... 34/124; 165/90

[58] Field of Search ..... 34/119, 125, 124, 110; 165/89, 90

[56] References Cited

U.S. PATENT DOCUMENTS 4,498,249 2/1985 Cooke et al. ..... 34/119

*Primary Examiner*—Henry A. Bennet

*Attorney, Agent, or Firm*—Steinberg & Raskin

[57] ABSTRACT

The invention concerns a steam and condensate coupling for a drying cylinder in a paper machine. The steam and condensate coupling includes a piston ring having a seal therein. This stationary, nonrevolving seal is pressed by means of steam pressure against the revolving axle or against a flange part or equivalent permanently connected to said axle. A piston ring is located in the coupling, which includes a face placed substantially perpendicularly to an axial direction of the cylinder, or slightly inclined from the perpendicular plane. In the coupling construction, steam pressure is passed onto the face of the piston ring, and a force is produced. By this force, the piston ring and the seal are pressed toward the revolving axle. Thereby, by means of the steam pressure, a pressure-tight joint is provided between the seal and the revolving axle.

12 Claims, 3 Drawing Sheets

STEAM AND CONDENSATE COUPLING FOR A DRYING CYLINDER IN A PAPER MACHINE

BACKGROUND OF THE INVENTION

The invention concerns a steam and condensate coupling for a drying cylinder in a paper machine.

By means of a steam and condensate coupling for a drying cylinder, a pressure-tight joint is formed between the revolving axle of the drying cylinder and the stationary constructions. By means of spring force and steam pressure, a seal ring is present against a revolving flange attached to the end of the axle. Steam and condensation pipes are passed through the axle journal, and a seal ring is fitted to surround said pipe systems.

The installation of a prior art coupling is a time consuming operation that imposes high requirements. The flanges attached to the end of the axle of the drying cylinder performs a swinging movement axially and radially. Frequently, such swinging remains to be corrected after the installation. Another drawback is that the replacement of the carbon seal in the coupling constructions is difficult to carry out. Also, the force with which the carbon is pressed against the flange attached to the end of the axle depends on the spring forces of the springs and of the bellows. Thus, the adjustability of the force is poor and, when the carbon seal is worn, the spring force becomes lower.

In the prior art coupling constructions, in starting situations, a high starting friction is produced on the carbon seal. Thereby the carbon is worn and damaged rapidly.

OBJECTS AND SUMMARY OF THE INVENTION

An object of the present invention is to provide a steam and condensate coupling of a novel type for a drying cylinder in a paper machine in which coupling the drawbacks mentioned above are avoided.

This object of the invention and others have been achieved by means of a solution provided herein. In the present invention, the sealing pressure applied to the carbon ring is mostly produced by a steam pressure applied to the face of a piston part. In view of a situation of negative pressure, the construction is provided with spiral springs. As a static seal, between the carbon and the piston part, a flat seal is used, and between the piston part and the coupling body a groove ring seal. As a limiter of radial movements of the piston, a guide band made of teflon is used. Rotation of the carbon ring is prevented by three pins and by a press ring.

The steam and condensate coupling in accordance with the invention for a drying cylinder in a paper machine comprises a piston ring and therein a seal, which is pressed by means of steam pressure against a revolving axle or against a flange part or equivalent permanently connected to said axle, and that there is a piston ring which comprises a face that is placed substantially perpendicularly to an axle direction of the roll, or slightly inclined from said perpendicular plane, the steam pressure being passed in the coupling construction onto said face and a force being produced, by which the piston ring and the seal provided in same are pressed with force towards the revolving axle. Thereby, by means of the steam pressure, a pressure tight joint is provided between the stationary, non-revolving seal and the revolving axle.

BRIEF DESCRIPTION OF THE DRAWINGS

The following drawings are illustrative of some preferred embodiments of the invention and are not meant to limit the scope of the invention as encompassed by the claims.

DETAILED DESCRIPTION

Figure 1:
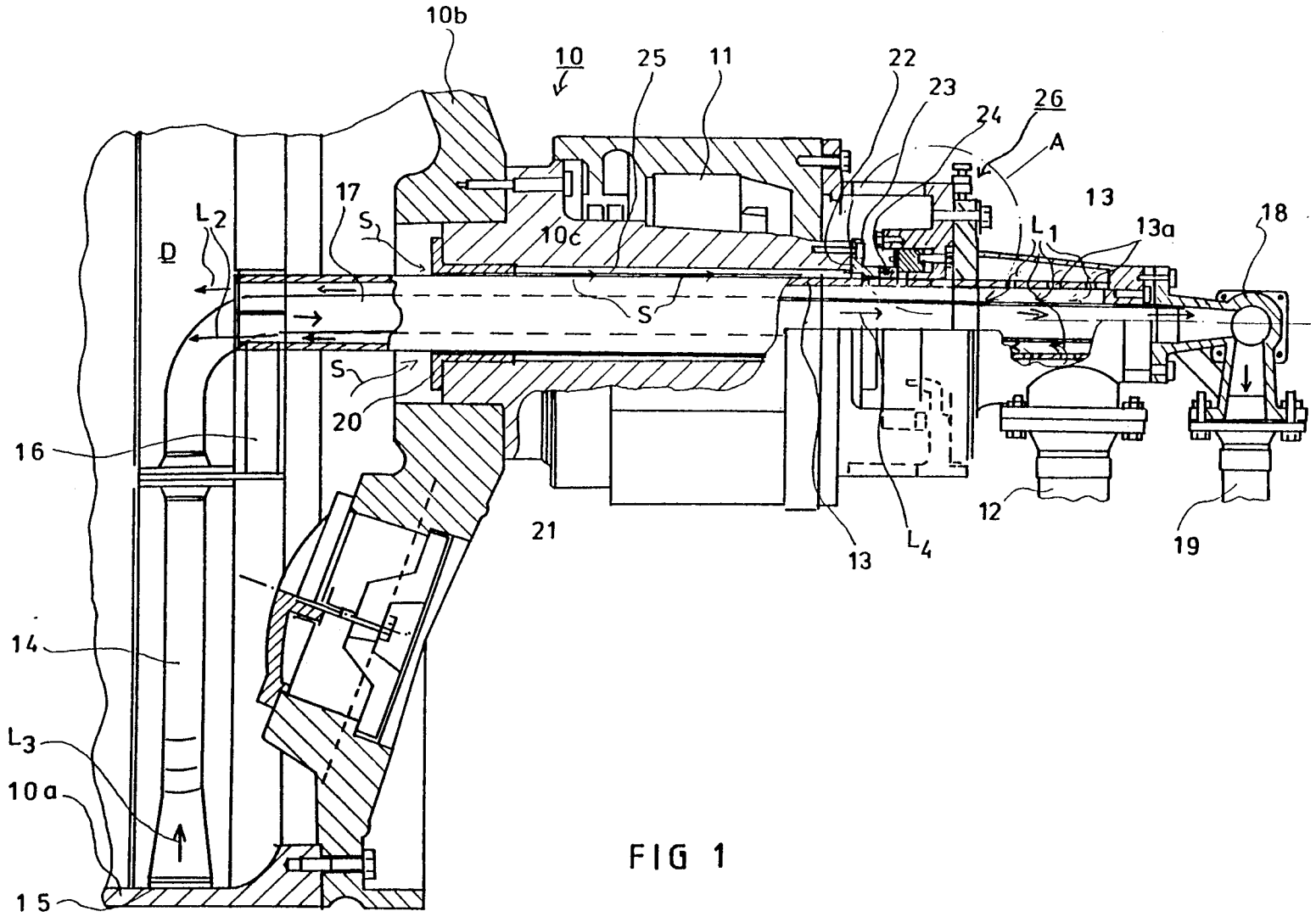
FIG. 1 is a sectional view of a steam and condensate coupling in accordance with the invention for a drying cylinder in a paper machine. What is shown is one end of the drying cylinder in a paper machine.

In the interior of the mantle 10*a*, the drying cylinder 10 comprises a space D, into which the steam is passed. The mantle 10*a* of the drying cylinder 10 is connected to the axle journal 10*c* by means of the flange 10*b*. The drying cylinder 10 is fitted to revolve on bearings 11.

The steam is introduced through a system of steam pipes 12 into the space inside the drying cylinder 10, and upon condensation of the steam the condensate water is carried out of the drying cylinder through a system of condensate pipes. The steam is passed out of the inlet steam pipe 12 into the steam pipe 13 parallel to the central axis X of the drying cylinder through perforation 13*a* at the end of the pipe. The steam flow out of the inlet steam pipe 12 into the steam pipe 13 through the perforations 13*a* at its end is illustrated by the arrows $L_1$.

The steam is discharged into the space D in the interior of the mantle 10*a* of the drying cylinder in the way indicated by the arrow $L_2$. After the steam has condensed and delivered its heat to the drying process, the condensate is carried, being collected by suction pipe 14, out of the condensate groove 15 provided on the inner face of the mantle 10*a*. The suction pipe is carried by a support 16. When the sense of rotation of the drying cylinder 10 is reversed, the position of the suction pipe 14 can be reversed.

The condensate water is carried out of the space D in the way indicated by the arrow $L_3$. Out of the suction pipe 14, the condensate is transferred into the condensate pipe 17, which is parallel to the central axis X of the drying cylinder 10. As is shown by the arrow $L_4$, the condensate is carried further through the flow indicator 18 into the exhaust pipe 19 and further out of connection with the drying cylinder. The outflow of the condensate is promoted by means of a pump (not shown). The condensate pipe 17 runs inside the steam pipe 13.

As is shown in the figure, the outer steam pipe 13 is supported by means of a support bushing 20. A shield pipe 21 is passed from the support bushing to the end flange 22 connected to the axle. The end flange 22 is connected to the end of the axle 10*c* by means of a screw 23, and the end flange 22 comprises a front face E, with which the seal, preferably a carbon ring 24, is connected. The steam pressure is passed out of the space between the shield pipe 25 and the steam pipe 13, out of the interior of the cylinder, to the condensate and steam coupling 26 in accordance with the invention.

Figure 2:
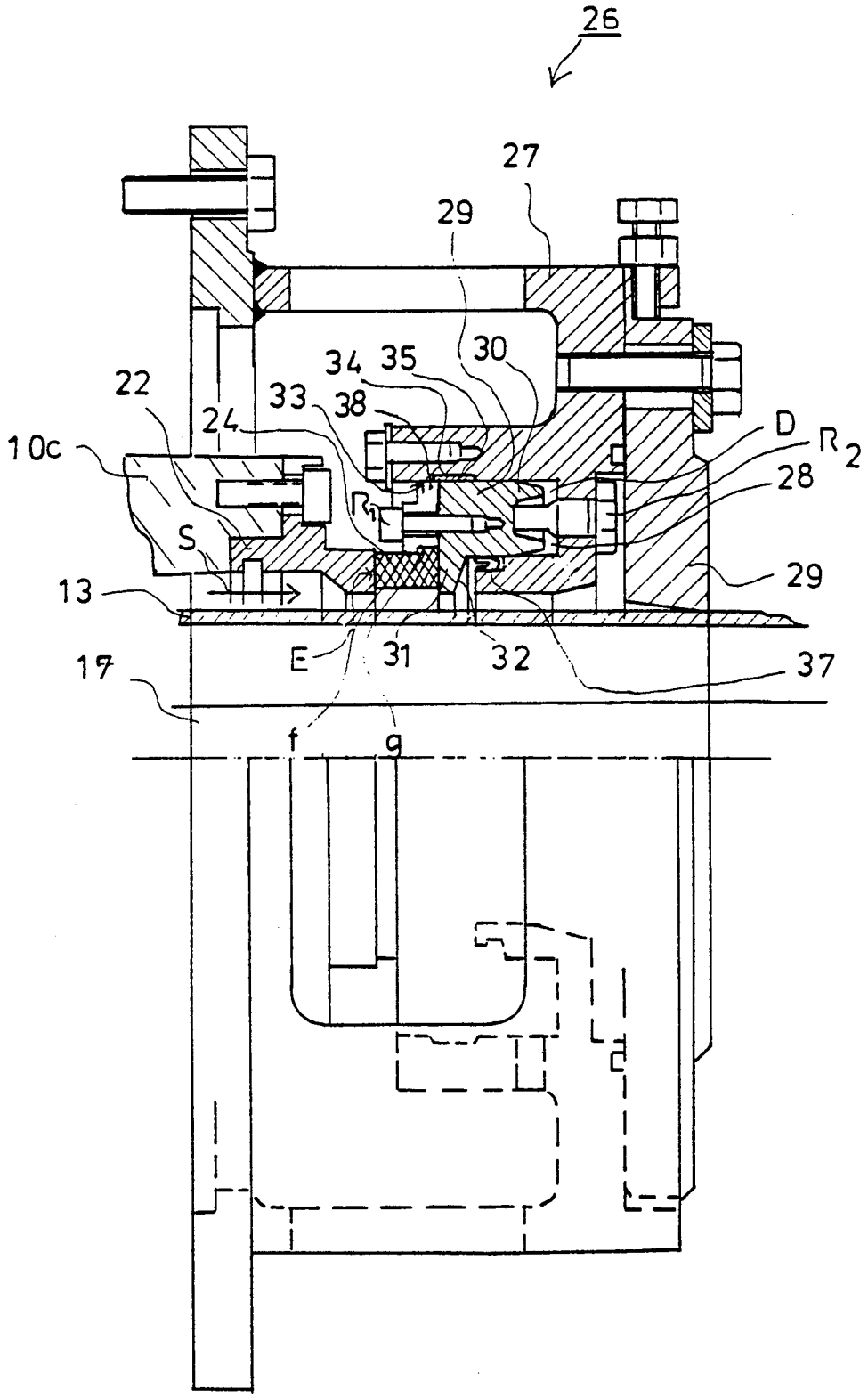
FIG. 2 shows the area A in FIG. 1. What is shown is an enlarged view of a coupling in accordance with the invention.

FIG. 2 is a more detailed illustration of the area A in FIG. 1 and of the stream and condensate coupling 26 in accordance with the invention. As is shown in FIG. 2, the steam and condensate coupling 26 comprises a rotary support frame 27 and therein an annular space 28 for a piston ring 29. The piston ring 29 is fitted to move in the axial direction (direction X) of the steam and condensate pipe and of the cylinder. The piston ring 29 comprises a piston part 30 and a projection part 31 projecting in an inward direction from the piston part 30. The projection part 31 comprises a face 32 arranged substantially perpendicular to the axial direction X, said face 32 being fitted to be affected by the steam pressure. The inside wall 33 defined by the annular space 28 in the rotatory support comprises a groove 34, to which a seal 35, preferably a seal band can be fitted.

A second seal 37, preferably a groove ring seal, is fitted to be effective between the wall of the annular space 28 and the piston ring 29. By means of the seal 37, access of the pressure into the space D between the end face of the piston part and the ring groove is excluded.

The flange 22 that revolves along with the axle 10*c* is connected in a sealing way against the seal ring 24 proper when the steam pressure is passed into contact with the face 32 of the piston ring 29. The seal 24, preferably a carbon ring seal, is fitted between the end face E of the piston part and the front face of the flange 22. The seal 24 is fitted to be attached to the piston ring 29 itself by means of a separate fastening ring 38 at the side opposite to the face of effect of the steam pressure on the projection part 31 of the piston ring 29. In such a case, the force F (see FIG. 3) acts directly at the seal 24.

Detrimental torque effects do not arise. As is shown in FIG. 2, the seal 24 is attached to the piston ring 29 so that the shoulder f on the fastening ring 38 engages a counter-shoulder g on the seal 24. When the fastening ring 38 is pressed by means of a screw $R_1$ or spring into contact with the piston part 29, the fastening ring 38 presses the seal 24 into tight contact with the piston part 29.

In the way shown in the figure, the other extreme position of the piston part is adjusted by means of a screw $R_2$ passed through the rotatory support, which screw is freely engaged in a hole h made into the piston ring 29. A radial movement of the piston part 29 is prevented by means of a seal band 35, which is fitted between the rotatory support and the piston ring 29.

Figure 3:
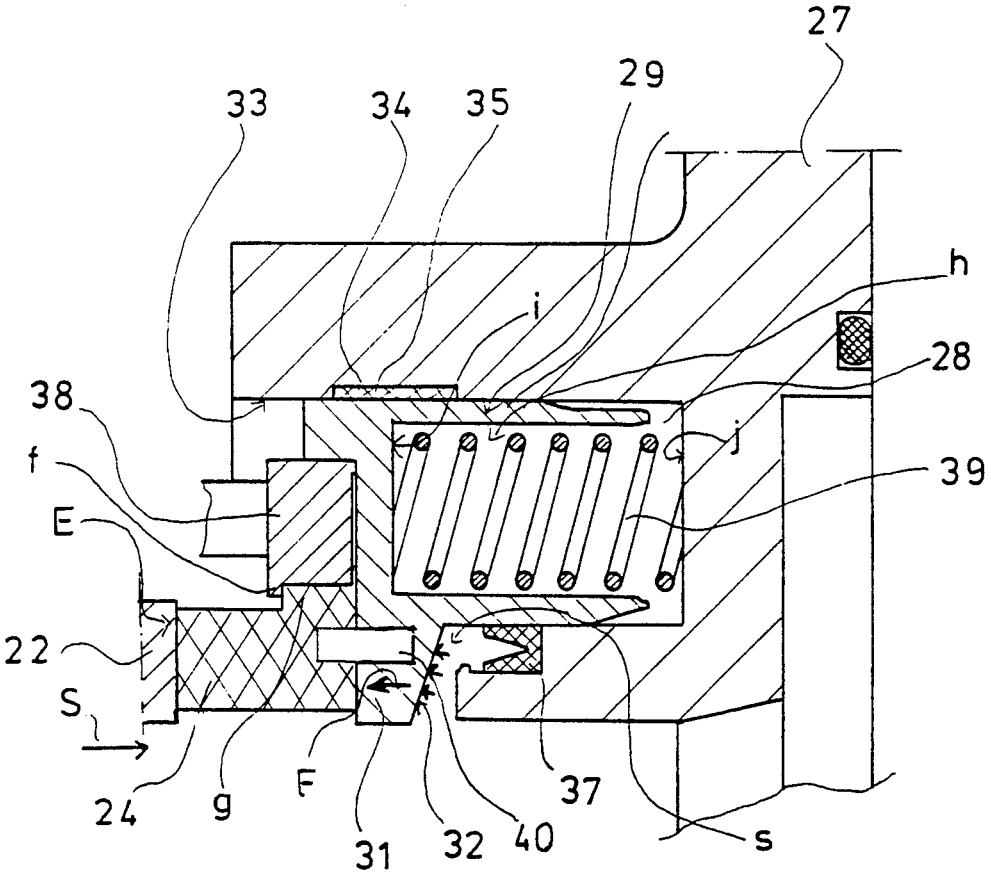
FIG. 3 shows a second preferred embodiment of a coupling in accordance with the invention.

FIG. 3 shows a second preferred embodiment of a coupling in accordance with the invention. In this embodiment, the piston ring 29 comprises a spring cavity h, into which the spring 39 is fitted when the spring acts between the bottom i of the spring cavity h and the bottom j of the ring groove provided for the piston part 29 in the rotatory support 27. By means of the force of the spring 39, the seal 24, preferably a carbon ring or any other durable seal, is kept in contact with its counter-face, i.e. in the embodiment shown in the figure, with the end face E of the flange connected to the end of the axle 10*c*.

Also, in the embodiment shown in FIG. 2, the sealing force proper is produced by passing the steam pressure out of the space D, in the way indicated by the arrow S, onto the face 32 of the piston ring 29 and by thereby, by means of the force F, acting upon the piston ring 29.

By means of the force F, the seal 24, which is attached to the piston part 29, is pressed against the end face E of the flange 22 that revolves along with the cylinder 10. Rotation of the carbon ring or of an equivalent seal 24, such as a ceramic seal, is prevented by a pin 40 employed between the piston part 29 and the seal 24, which pin 40 prevents rotation.

We claim:

1. An arrangement for a drying cylinder in a paper machine, comprising a stationary steam and condensate coupling comprising a steam pipe structured and arranged to pass steam into a space inside a drying cylinder, and a condensate pipe structured and arranged to remove condensate from the interior space in the drying cylinder, a revolving axle for the drying cylinder, said steam and condensate pipes being passed through said axle, a stationary, non-revolving seal located between said axle and said coupling, said coupling further comprising a piston ring arranged to move along an axial direction of said steam and condensate pipes, said piston ring having a face placed substantially perpendicularly to said axial direction, and sealing means for pressing said seal against said axle, said piston ring and said seal being pressed toward said axle by a force produced by steam passed in said coupling onto said face of said piston ring, such that by means of the steam pressure, a pressure-tight joint is provided between said seal and said axle, a flange permanently connected to said axle, said seal being pressed against said flange part such that the pressure-tight joint is provided between said seal and said flange, and a rotatory support having an annular space therein, said piston ring comprising a piston part arranged to move in said annular space and said face of said piston ring being located on a projection part that projects from said piston part.

2. The arrangement of claim 1, wherein said face of said piston ring is slightly inclined from said perpendicular plane.

3. The arrangement of claim 1, further comprising a second seal located between said piston ring and said rotatory support, and that on a wall of said annular space provided for said piston ring in said rotatory support, said coupling comprises a third seal structured and arranged to minimize the radial movement of said piston ring.

4. The arrangement of claim 3, wherein said second seal is a groove-ring seal.

5. The arrangement of claim 1, wherein said seal is connected to said face of said piston ring.

6. The arrangement of claim 1, wherein said seal is attached to said piston ring by means of a fastening ring.

7. The arrangement of claim 6, further comprising means for pressing said seal into contact with said piston ring, said seal including a shoulder, said fastening ring having a counter-shoulder, such that when said seal is pressed into contact with said piston ring, said counter-shoulder of said fastening ring presses against said shoulder of said seal, thereby pressing said seal into its position in contact with said piston ring.

8. The arrangement of claim 7, wherein said means for pressing said seal comprises a screw or a spring.

9. The arrangement of claim 1, wherein said coupling comprises a spring between said piston ring and said rotatory support, said spring being fitted by means of its spring force to press said piston ring and said seal against said revolving axle.

10. The arrangement of claim 1, wherein said coupling comprises a spring between said piston ring and said rotatory support, said spring being fitted by means of its spring force to press said piston ring and said seal against a flange attached to said revolving axle.

11. The arrangement of claim 12, wherein said spring is arranged in a spring cavity in said piston ring between a bottom of said spring cavity and a bottom of said annular space provided for said piston part in said rotatory support.

12. The arrangement of claim 1, wherein said coupling further comprises a screw arranged between said rotatory support and said piston ring, such that an extreme position of the movement of said piston part is adjustable by threading said screw.

* * * * *